US012590435B2

(12) United States Patent
Trow

(10) Patent No.: US 12,590,435 B2
(45) Date of Patent: Mar. 31, 2026

(54) TRACTOR ATTACHMENT ACCESSORIES

(71) Applicant: Fields Log Master LLC, Newberg, OR (US)

(72) Inventor: Larry Trow, Newberg, OR (US)

(73) Assignee: Fields Log Master LLC, Newberg, OR (US)

( * ) Notice: Subject to any disclaimer, the term of this patent is extended or adjusted under 35 U.S.C. 154(b) by 0 days.

(21) Appl. No.: 18/968,612

(22) Filed: Dec. 4, 2024

(65) Prior Publication Data

US 2025/0179761 A1 Jun. 5, 2025

Related U.S. Application Data

(60) Provisional application No. 63/606,353, filed on Dec. 5, 2023.

(51) Int. Cl.
*E02F 3/413* (2006.01)

(52) U.S. Cl.
CPC ..... *E02F 3/413* (2013.01)

(58) Field of Classification Search
CPC .. E02F 3/40; E02F 3/404; E02F 3/413; A01B 43/00
USPC ..... 37/303, 406, 302, 405, 409; 414/23
See application file for complete search history.

(56) References Cited

U.S. PATENT DOCUMENTS 2,615,262 A * 10/1952 Reid, Sr. ..... E02F 3/8152 37/405
3,077,999 A * 2/1963 Svoboda ..... E02F 3/4133 37/409
3,148,787 A * 9/1964 Clark ..... E02F 3/404 37/405
3,419,170 A * 12/1968 Salna ..... E02F 3/401 37/409
3,595,416 A * 7/1971 Perrotti ..... E02F 3/401 37/405
4,155,473 A * 5/1979 Holopainen ..... A01D 87/0069 414/722
4,372,063 A * 2/1983 Work ..... A01G 23/093 37/409
4,403,906 A * 9/1983 Holopainen ..... E02F 3/404 414/724
4,845,867 A * 7/1989 Albrecht ..... E02F 3/404 37/468
5,094,581 A * 3/1992 Lamb ..... E02F 3/404 37/405
5,114,299 A * 5/1992 Roche ..... E02F 3/404 414/722

(Continued)

*Primary Examiner* — Jamie L McGowan

(74) *Attorney, Agent, or Firm* — Chernoff, Vilhauer LLP

(57) ABSTRACT

Tractor attachment accessories and methods of lifting a log with the tractor attachment accessories. In some examples, the tractor attachment accessory includes an elongate base member having first and second longitudinal end portions. The tractor attachment accessory additionally includes a mounting assembly attachable to a tractor attachment. The first longitudinal end portion of the elongate base member is pivotably connected to the mounting assembly. The tractor attachment accessory further includes a cross member attached to, or formed with, the second longitudinal end portion of the elongate base member. The tractor attachment accessory additionally includes two or more spaced prongs attached to, or formed with, the cross member.

16 Claims, 5 Drawing Sheets

(56) References Cited

U.S. PATENT DOCUMENTS 5,314,292 A * 5/1994 Holopainen ..... E02F 3/404 37/406
5,544,435 A * 8/1996 Somero ..... E02F 3/404 37/405
5,553,408 A * 9/1996 Townsend ..... E02F 3/404 414/722
5,678,332 A * 10/1997 Hawkins ..... E02F 3/965 414/722
5,797,461 A * 8/1998 Noble ..... E02F 3/404 37/405
5,957,650 A * 9/1999 Rollo ..... E02F 3/962 37/406
6,260,294 B1 * 7/2001 Pitcher ..... E02F 3/404 37/406
6,263,774 B1 * 7/2001 Rogness ..... A01D 87/127 83/578
6,287,072 B1 * 9/2001 Wasilas ..... E02F 3/404 37/406
7,354,239 B2 * 4/2008 Deyo ..... E02F 3/404 37/406
8,069,591 B2 * 12/2011 Dunn ..... E02F 3/401 37/406
8,109,709 B1 * 2/2012 Gaetze ..... E02F 3/404 37/406
8,991,079 B2 * 3/2015 Stewart ..... E02F 3/402 37/405
9,284,713 B2 * 3/2016 Kobayashi ..... E02F 3/404
10,584,462 B2 * 3/2020 Burenga ..... A01B 43/00
11,571,723 B1 * 2/2023 Innes ..... B02C 4/02
2002/0044862 A1 * 4/2002 Burton ..... E02F 3/34 37/405
2002/0100193 A1 * 8/2002 Larsen ..... E02F 3/404 37/403
2003/0031547 A1 * 2/2003 Stumvoll ..... E02F 3/34 414/723
2004/0253089 A1 * 12/2004 Atencio ..... A01D 87/0076 414/724
2005/0115638 A1 * 6/2005 Solesbee ..... E02F 3/404 144/4.1
2005/0220601 A1 * 10/2005 Pisco ..... E02F 3/404 414/723
2006/0283056 A1 * 12/2006 Risch ..... E02F 3/402 37/466
2008/0307681 A1 * 12/2008 McNeil ..... E02F 3/815 37/405
2009/0290966 A1 * 11/2009 King ..... E02F 3/404 414/739
2011/0217153 A1 * 9/2011 Lanting ..... E02F 3/96 414/723
2011/0318158 A1 * 12/2011 Miller ..... E02F 3/962 414/815
2012/0301257 A1 * 11/2012 Seljestad ..... E02F 3/404 414/722
2013/0192098 A1 * 8/2013 Matsumoto ..... E02F 3/404 37/406
2013/0259627 A1 * 10/2013 Seljestad ..... E02F 3/404 414/815
2014/0178165 A1 * 6/2014 Stewart ..... B66C 1/68 414/724
2015/0071700 A1 * 3/2015 Miller ..... E02F 3/404 403/14
2015/0354166 A1 * 12/2015 Haveman ..... E02F 3/404 37/405
2016/0177538 A1 * 6/2016 Seljestad ..... E02F 3/404 37/406
2016/0312433 A1 * 10/2016 Parker ..... E02F 3/3677
2016/0340862 A1 * 11/2016 Miller ..... E02F 3/413
2018/0066407 A1 * 3/2018 Slaby ..... A46B 5/0041
2018/0216311 A1 * 8/2018 Kenworthy ..... E02F 3/4133
2019/0119878 A1 * 4/2019 Frey ..... E02F 3/964
2019/0350134 A1 * 11/2019 Guiet ..... E02F 3/413
2020/0157767 A1 * 5/2020 Burenga ..... E02F 3/404
2020/0283990 A1 * 9/2020 Clearman ..... E02F 3/40

* cited by examiner

TRACTOR ATTACHMENT ACCESSORIES

CROSS REFERENCE TO RELATED APPLICATIONS

This application claims the benefit of U.S. Provisional Patent Application No. 63/606,353 filed on Dec. 5, 2023 and entitled "Multi-Purpose Tractor Fork Attachment And Mounting Mechanism Systems And Methods." The complete disclosure of the above application is hereby incorporated by reference for all purposes.

FIELD OF THE DISCLOSURE

The present disclosure pertains to a tractor attachment accessory designed to facilitate the handling, lifting, and manipulation of a wide array of objects.

BACKGROUND

Heavy machinery, particularly within agriculture, construction, and materials handling industries, is used for the efficient handling of objects, tools, and materials. As the demands of these sectors continue to grow, so too does the need for versatile, reliable, and adaptable equipment to meet the evolving challenges faced by operators and workers. Whether it is maneuvering loads of varying shapes and sizes, adapting to different operational scenarios, or ensuring the safety of both equipment and personnel, the machinery used in these fields plays an important role in productivity and performance.

One of the fundamental gaps in existing heavy machinery is the capability to interchange and utilize various attachments seamlessly. The adaptability of these machines to accommodate different implements, from loaders and buckets to specialized tools, directly impacts their overall utility. In a landscape where versatility and cost-efficiency are paramount, the need for innovation in heavy machinery attachments and attachment mechanisms and their secure integration into existing machinery becomes increasingly apparent.

Moreover, operators and users in these industries frequently encounter scenarios where specialized attachments are either unavailable for specific tasks, necessitating replacement or customization to meet unique requirements. Additionally, heavy machinery that combines multiple attachments for multifaceted operations is not common. A failure to accommodate these changing needs can result in operational inefficiencies and an inability to meet the diverse demands of the job.

What is needed, therefore, is an adaptable attachment accessory that effectively capitalizes on the existing structure and controls of heavy machinery and obviates the need for additional complex control systems.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
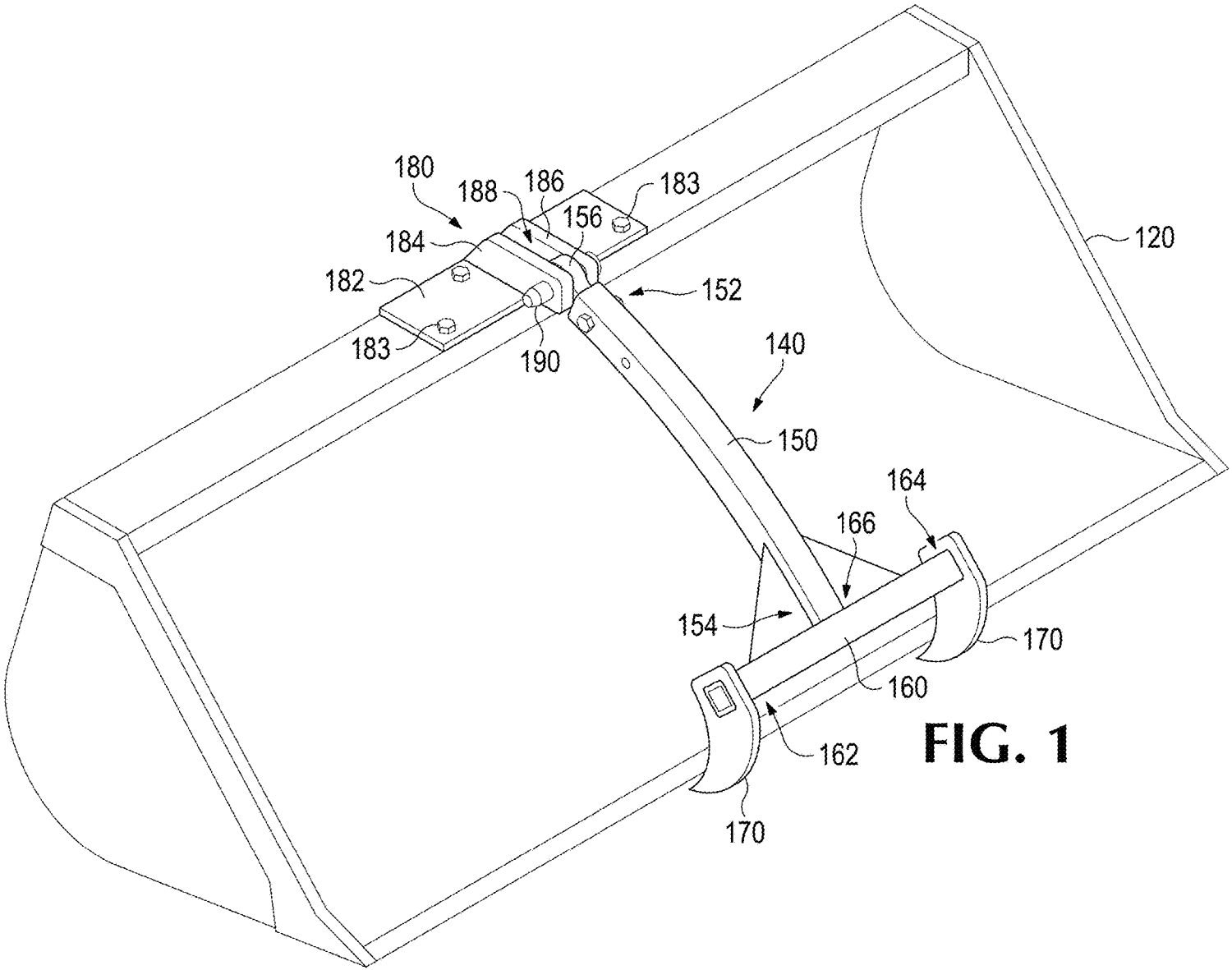
FIG. 1 is an isometric view of an example of a tractor attachment accessory pivotably attached to a bucket attachment.
Figure 2:
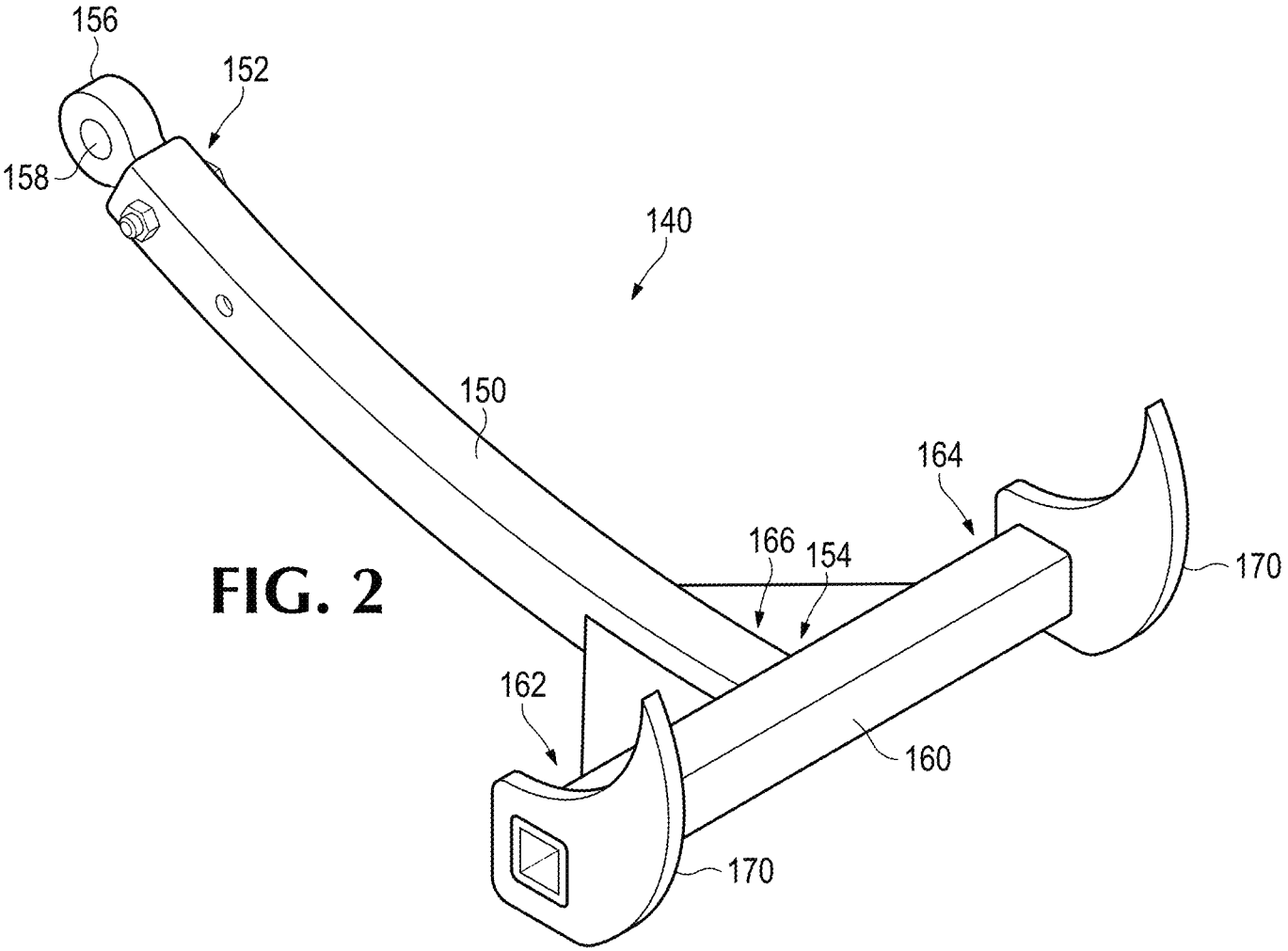
FIG. 2 is another isometric view of the tractor attachment accessory of FIG. 1 shown without the mounting assembly.
Figure 3:
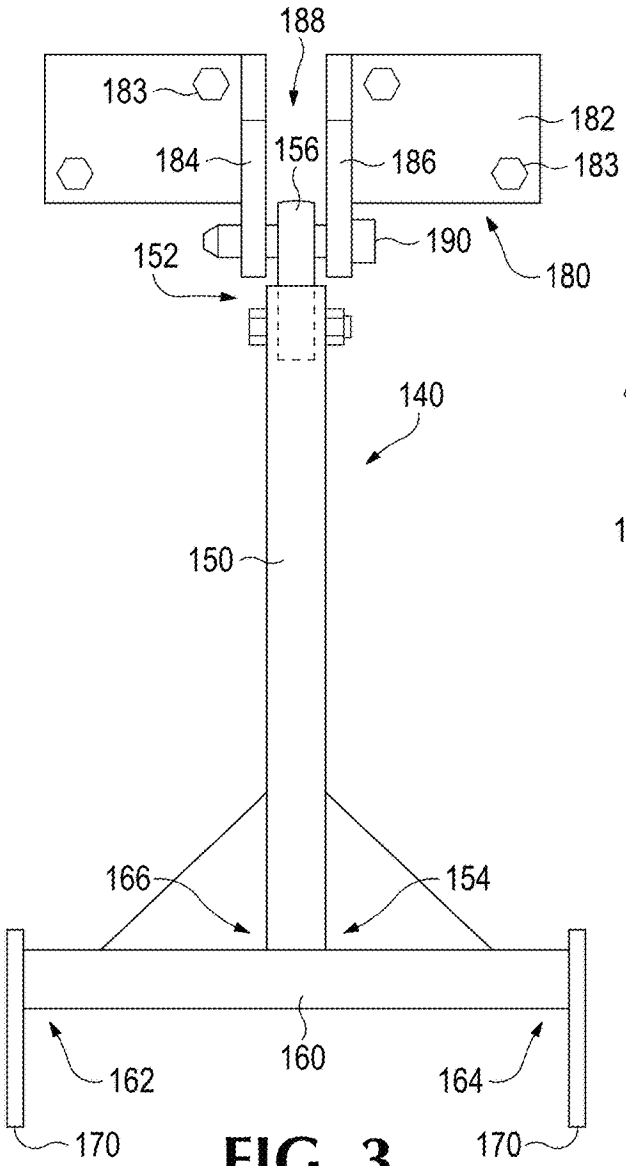
FIG. 3 is a top view of the tractor attachment accessory of FIG. 1.

Referring to FIGS. 1-3, a tractor attachment 120 and a tractor attachment accessory 140 attached to the tractor attachment are shown. Tractor attachment 120 can encompass a wide array of attachments traditionally affixed to tractors or other vehicles, or other machinery, which may include front-end loaders, buckets, pallet forks, grapples, augers, plows, cultivators, or other specialized equipment designed for diverse applications in agriculture, construction, materials handling, and beyond.

In certain embodiments, the presence of tractor attachment 120 is not required. Operators and users can choose to mount the tractor attachment accessory 140 directly on to the tractor or other agricultural, materials handling, or construction vehicle. This expands the application potential of the invention, accommodating scenarios where attachment replacement or customization is necessary or when no attachment is involved.

Tractor attachment accessory 140 is designed for secure object handling. In the example shown in FIGS. 1-3, the tractor attachment accessory is a log-handling fork that includes a main tube or elongate base member 150, a cross tube or cross member 160, and two or more claws or prongs 170. Two or more components of the tractor attachment accessory may be crafted from a single, continuous piece of robust material, such as sturdy metal, steel, or a similar resilient substance.

Main tube 150 includes opposed longitudinal end portions 152 and 154. End portion 152 is attached to the tractor attachment or the tractor (or other vehicle), while end portion 154 is attached to, or formed with, cross tube 160. The length of the main tube may be adapted such that the tractor attachment accessory spans or substantially spans, for example, across a bucket of a bucket attachment, such as approximately 26 inches. In other embodiments, the length of main tube 150 is adjustable by having two main tubes, one inside the other (not shown). In those embodiments, the length of main tube 150 may be adjusted using, for example, a pin and hole system, a telescopic tube, or any other suitable mechanism.

Main tube 150 is arcuate or has a slight curvature allowing for ease of object manipulation. The curvature of main tube 150 is such that the concave side of the curvature is oriented toward the ground during operation, while the convex side of the curvature is oriented towards the opposite side. This design feature enhances object handling by promoting even weight distribution of the load and ensuring a secure, stable grip on objects.

Cross tube 160 is attached to, or formed with, the main tube. In the example shown in FIGS. 1-3, the cross tube is perpendicular to the main tube such that the tractor attachment accessory is a T-shaped structure. In some embodiments, welding or robust attachment hardware is used to attach the cross tube to the main tube. In other embodiments, cross tube 160 and main tube 150 are formed from an integral, single piece of material such as metal, steel, or other sturdy material. Cross tube 160 includes opposed longitudinal end portions 162 and 164 and a central portion 166 disposed between those end portions. In the example shown in FIGS. 1-3, end portion 154 of main tube 150 is attached to, or formed with, central portion 166 of cross tube 160.

Prongs 170 are attached to, or formed with, cross tube 160 in a spaced relationship. In the example shown in FIGS. 1-3, the prongs are situated at each end portion 162, 164 of the cross tube. The prongs may be any suitable shape(s) configured to securely grasp, lift, and/or manipulate objects (e.g., logs), such as various axe blade shapes. In some embodiments, the tractor attachment accessory includes more than two prongs 170. For example, tractor attachment accessory 140 may include a third prong (not shown) attached to, or formed at, the middle of cross tube 160, or may include four prongs (not shown) with two being attached to, or formed with, the cross tube on either side of the main tube. The prongs are securely attached to the cross tube through welding or other robust connection methods. In some embodiments, the prongs and the cross tube are formed from an integral, single piece of material such as metal, steel, or other sturdy material to further enhance the stability of the fork attachment accessory.

In the example shown in FIGS. 1-3, tractor attachment accessory 140 also includes a mounting assembly 180 that is attachable to a tractor attachment or tractor (or other vehicle). Mounting assembly 180 includes one or more planar mounting bases 182 and opposed and spaced walls 184 and 186 that extend away from the mounting base(s).

Mounting base 182 includes hole or apertures 183 sized to receive fasteners to attach the mounting base to the tractor attachment or tractor. Walls 184 and 186 define a channel 188 therebetween that is sized to receive an eyebolt 156 of end portion 152 of main tube 150. The mounting assembly also includes a pin 190 that is received in corresponding holes 192 and 194 of walls 184 and 186, respectively and in hole 158 of eyebolt 156 such that main tube 150 is pivotably connected to tractor attachment or tractor. In other embodiments, mounting assembly 180 may include alternative attachment mechanisms, such as quick-release couplings, interlocking teeth or gear mechanism, hitch and receiver system, latching mechanism, etc.

Figure 4:
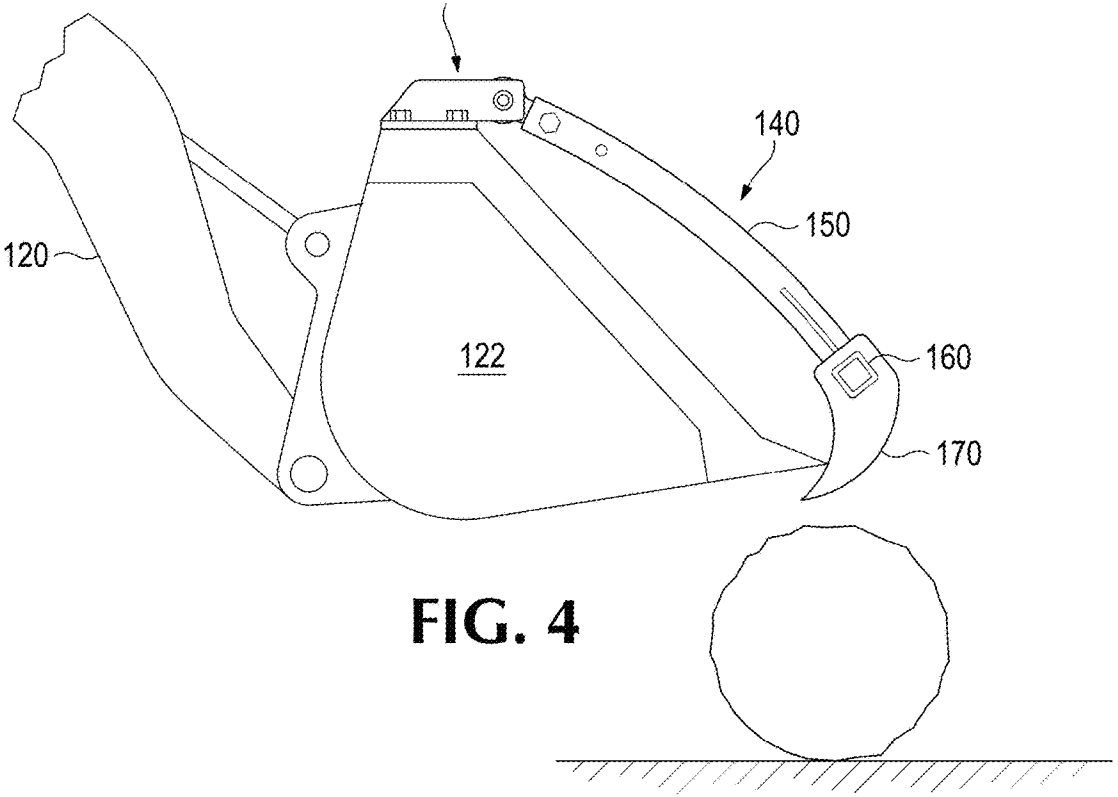
FIGS. 4-8 are partial side views showing the tractor attachment accessory of FIG. 1 used in combination with a bucket attachment to lift and carry a log.
Figure 6:
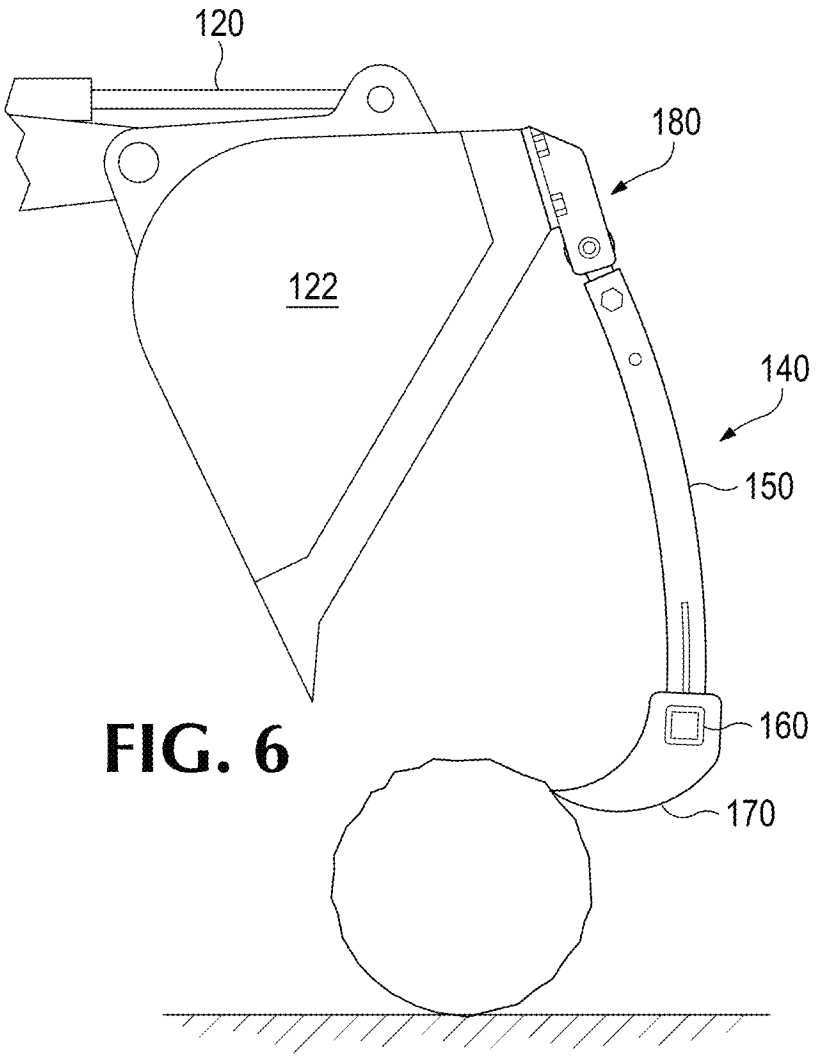
Figure 5:
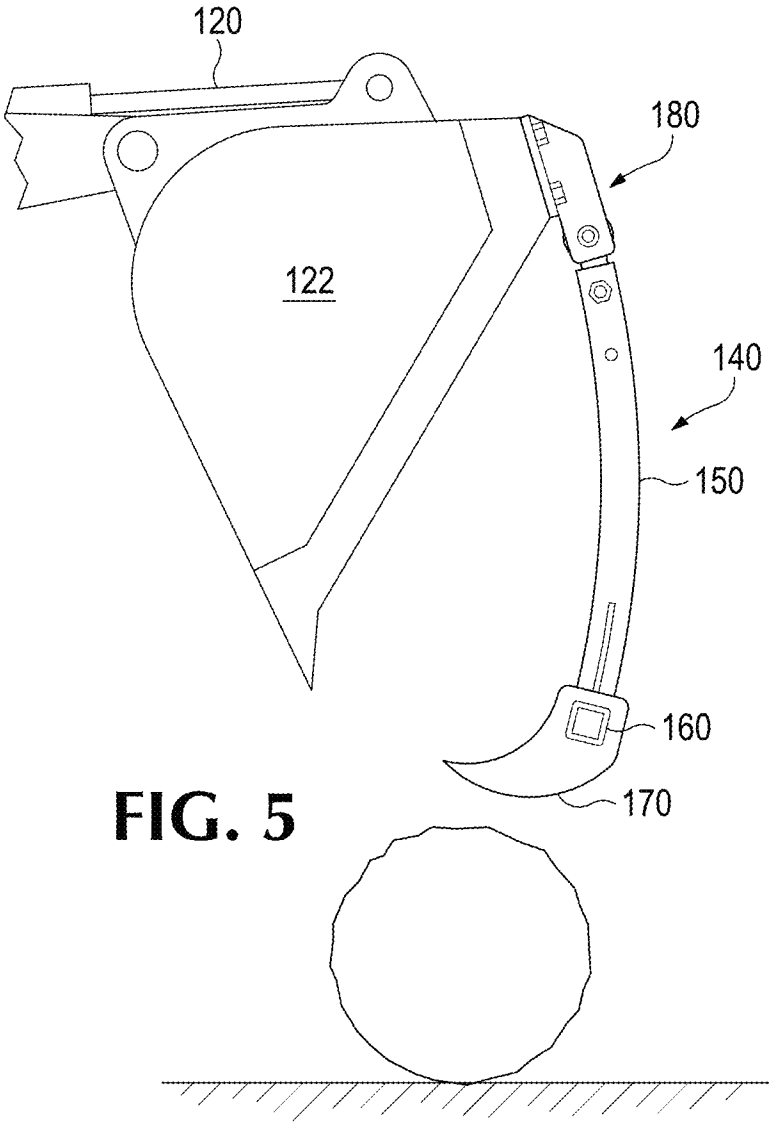
Figure 7:
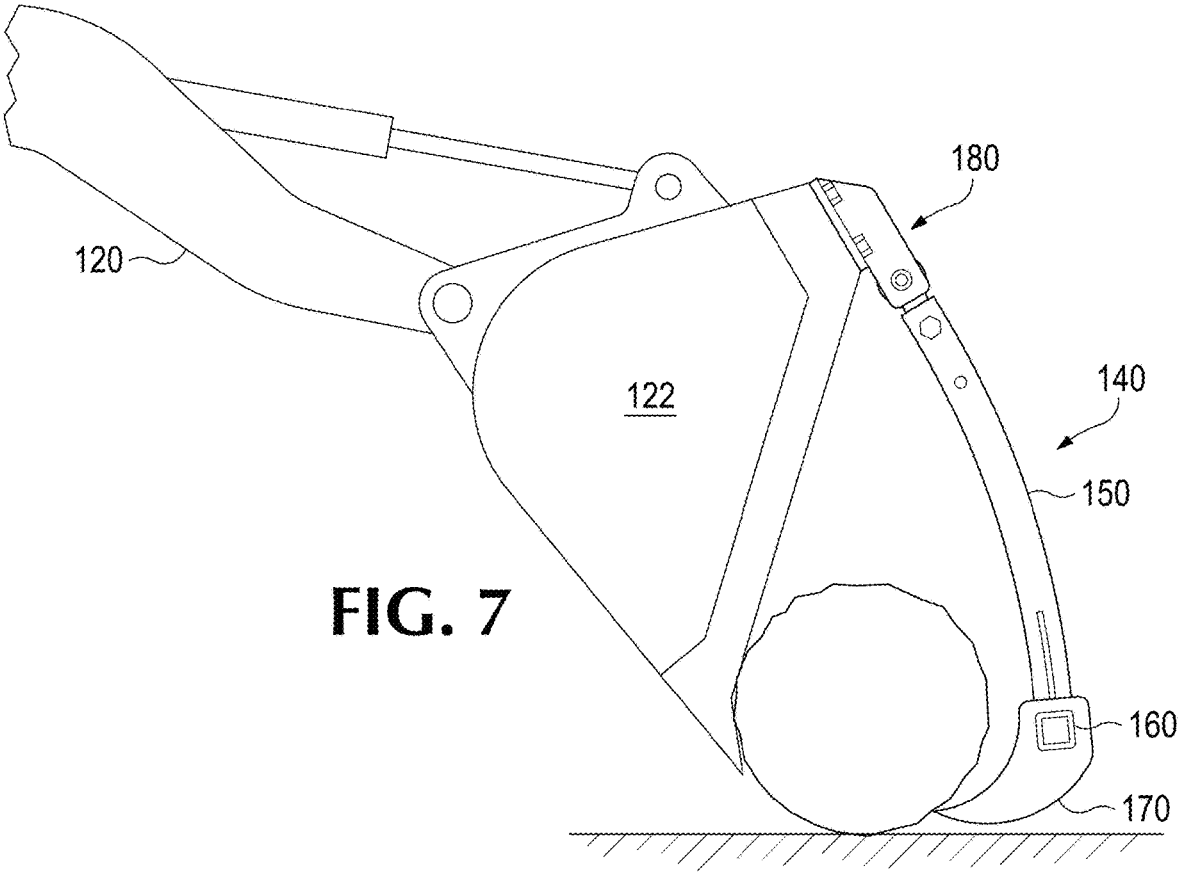
Figure 8:
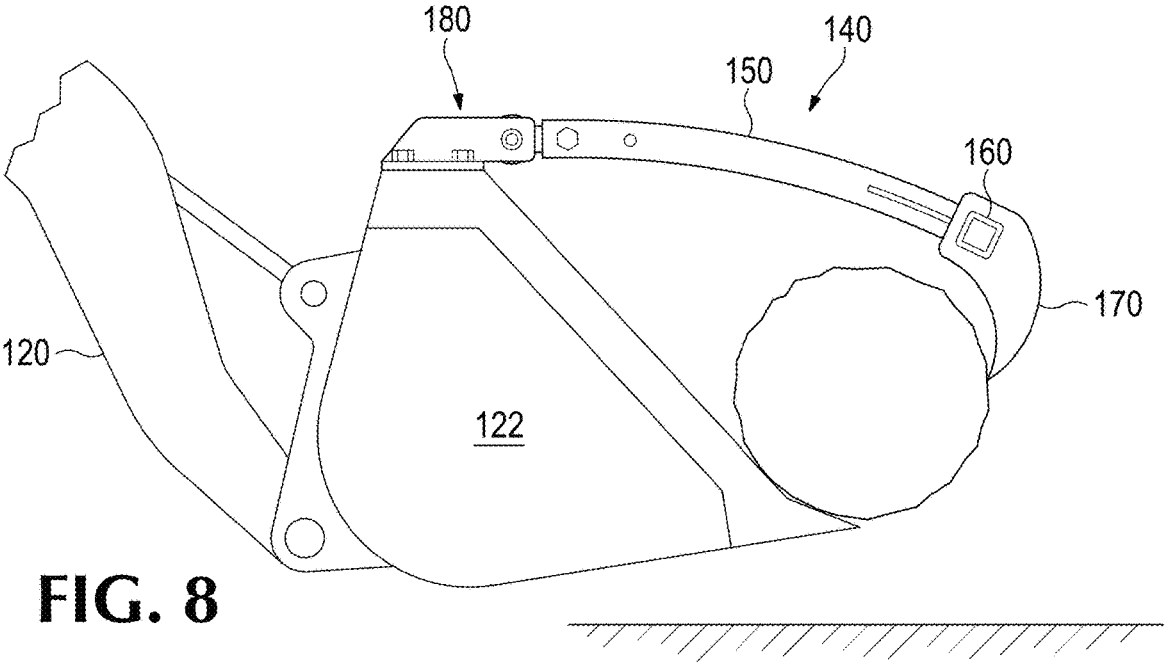

Referring to FIGS. 4-8, an example of a method of lifting a log with a tractor having a bucket attachment 120 with a bucket 122 and a tractor attachment accessory 140 attached to the bucket. In FIG. 4, the tractor moves toward the log such that the bucket is pointed upward and the tractor attachment accessory is above the log. In FIG. 5, the bucket is raised and pivoted downward. In FIG. 6, the bucket is lowered such that at least one prong of the two or more prongs contacts the log but the bucket does not contact the log. In FIG. 7, the bucket is lowered to contact the log such that the log is received and disposed between the bucket and the tractor attachment accessory. In FIG. 8, the bucket is raised and pivoted upward to lift the log. Although a tractor having a bucket attachment is shown, the tractor attachment accessories of the present disclosure may be used with any suitable attachment on any suitable vehicle.

The present disclosure effectively capitalizes on the existing controls and movements of the tractor, obviating the need for additional complex control systems. As the tractor's arms or other movable components are manipulated by the user, the fork attachment accessory 140 follows suit, offering precision and ease in object handling.

To substantiate the scope of this disclosure, an extensive array of alternative embodiments can be considered, accommodating various materials, sizes, attachment mechanisms, and methods of attachment. This adaptability ensures the invention can be tailored to meet diverse requirements and applications. In some embodiments, however, the tractor attachment accessories of the present disclosure include only the components described above and/or shown in FIGS. 1-8 to the exclusion of other components and/or structures not described and/or shown. For example, the tractor attachment accessories of the present disclosure may exclude any structures that are opposed to the cross tube and/or prongs (e.g., opposed cross tube and/or prongs to form opposed "claws" for lifting a log).

The various components of the disclosure can be fabricated from an assortment of materials, including different metals, alloys, or composite materials. The choice of material depends on the desired strength, weight, and environmental considerations, allowing for versatile design options.

In addition to the foregoing description, it is to be understood that various embodiments and modifications of the invention may be readily apparent to those skilled in the art without departing from the spirit or scope of the present invention.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

What is claimed is:

1. A tractor attachment assembly, comprising:

a bucket attachment including at least one boom and a bucket pivotably attached to the at least one boom; and a bucket attachment accessory including:

a single elongate base member having first and second longitudinal end portions, the elongate base member being made of a single continuous piece of metal;

a mounting assembly fixedly attached to the bucket, the first longitudinal end portion of the elongate base member being pivotably connected to the mounting assembly;

a single cross member fixedly and directly attached to the second longitudinal end portion of the elongate base member, the cross member being made of a single continuous piece of metal, wherein the cross member is perpendicular to the elongate base member; and two or more spaced prongs fixedly and directly attached to, or directly formed with, the cross member, wherein the elongate base member pivots relative to the mounting assembly, and wherein the elongate base member is connected to only the mounting assembly and the cross member, and wherein the mounting assembly is connected to only the bucket and the elongate base member.

2. The tractor attachment assembly of claim 1, where the cross member includes third and fourth longitudinal end portions and a central portion disposed between the third and fourth longitudinal end portions, wherein a first prong of the two or more prongs is attached to, or formed with, the third longitudinal end portion, and a second prong of the two or more prongs is attached to, or formed with, the fourth longitudinal end portion.

3. The tractor attachment assembly of claim 2, wherein the central portion of the cross member is attached to, or formed with, the second longitudinal end portion of the elongate base member.

4. The tractor attachment assembly of claim 1, wherein the first longitudinal end portion of the elongate base member includes an eyebolt.

5. The tractor attachment assembly of claim 4, wherein the mounting assembly includes a planar mounting base and two opposed walls attached to, or formed with, the mounting base, the two opposed walls extending away from the mounting base and defining a channel therebetween to receive the eyebolt.

6. The tractor attachment assembly of claim 5, wherein each of the two or more walls includes a hole, wherein the mounting assembly further includes a pin received in the holes of the two opposed walls and in the eyebolt such that the elongate base member is pivotably connected to the mounting assembly.

7. The tractor attachment of claim 1, wherein the mounting assembly includes a mounting base includes a plurality of apertures sized to receive a plurality of fasteners to fixedly attach the mounting base to the tractor attachment.

8. The tractor attachment assembly of claim 1, wherein the elongate base member is arcuate.

9. The tractor attachment assembly of claim 1 in combination with a tractor, wherein the tractor attachment assembly is attached to the tractor.

10. A method of lifting a log with a tractor having the bucket attachment and the bucket attachment accessory of claim 1, the method comprising:

moving the tractor such that the bucket attachment accessory is above the log;

pivoting the bucket downward;

lowering the bucket such that at least one prong of the two or more prongs contacts the log;

lowering the bucket to receive the log between the two or more prongs and the bucket; and pivoting the bucket upward and lifting the bucket to lift the log.

11. The tractor attachment assembly of claim 1, wherein the elongate base member and the cross member are made of the same single continuous piece of metal.

12. The tractor attachment assembly of claim 1, wherein the bucket attachment includes a bucket having opposed first and second transverse end portions, the mounting assembly being attachable to the first transverse end portion and the elongate base member and the cross member being sized such that the tractor attachment accessory spans from the first transverse end portion to the second transverse end portion when the mounting assembly is attached to the first transverse end portion.

13. The tractor attachment assembly claim 1, wherein the bucket includes opposed first and second transverse end portions, the mounting assembly being attached to the first transverse end portion, and the elongate base member and the cross member being sized such that the tractor attachment accessory spans the distance between the first and second transverse end portions.

14. A tractor attachment assembly, comprising:

a bucket attachment including at least one boom and a bucket pivotably attached to the at least one boom; and a bucket attachment accessory including:

a single elongate base member having first and second longitudinal end portions, the elongate base member being made of a single continuous piece of metal, wherein the first longitudinal end portion of the elongate base member includes an eyebolt;

a mounting assembly including only (1) a planar mounting base fixedly attached to the bucket, (2) two opposed walls attached to, or formed with, the mounting base, and (3) a pin, the two opposed walls extending away from the mounting base and defining a channel therebetween to receive the eyebolt fixedly attached to the bucket, wherein each of the two or more walls includes a hole, wherein the pin is received in the holes of the two opposed walls and in the eyebolt such that the elongate base member is pivotably connected to the mounting assembly;

a single cross member fixedly and directly attached to the second longitudinal end portion of the elongate base member, the cross member being made of a single continuous piece of metal, wherein the cross member is perpendicular to the elongate base member; and two or more spaced prongs fixedly and directly attached to, or directly formed with, the cross member, wherein the elongate base member pivots via the least one pivot pin relative to the mounting assembly, and wherein the elongate base member is connected to only the pivot pin of the mounting assembly and the cross member, and wherein the mounting assembly is connected to only the bucket and the eyebolt of the elongate base member.

15. A tractor attachment assembly, consisting:

a bucket attachment including at least one boom and a bucket pivotably attached to the at least one boom; and a bucket attachment accessory consisting:

a single elongate base member having first and second longitudinal end portions, the elongate base member being made of a single continuous piece of metal;

a mounting assembly fixedly attached to the bucket, the first longitudinal end portion of the elongate base member being pivotably connected to the mounting assembly;

a single cross member fixedly and directly attached to the second longitudinal end portion of the elongate base member, the cross member being made of a single continuous piece of metal, wherein the cross member is perpendicular to the elongate base member; and two or more spaced prongs fixedly and directly attached to, or directly formed with, the cross member, wherein the elongate base member pivots relative to the mounting assembly, and wherein the elongate base member is connected to only the mounting assembly and the cross member, and wherein the mounting assembly is connected to only the bucket and the elongate base member.

16. The tractor attachment assembly of claim 15, wherein the first longitudinal end portion of the elongate base member includes an eyebolt, and wherein the mounting assembly consists of (1) a mounting base fixedly attached to the bucket, (2) two opposed walls attached to, or formed with, the mounting base, and (3) a pivot pin, wherein the two opposed walls extends away from the mounting base and define a channel therebetween to receive the eyebolt, wherein each of the two or more walls includes a hole, wherein the pivot pin is received in the eyebolt and the holes of the two opposed walls to pivotably connect the elongate base member to the mounting assembly via the least one pivot pin.

* * * * *